United States Patent [19]

Ishii

[11] 4,344,362

[45] Aug. 17, 1982

[54] IMPRESSION CYLINDER CLEANING DEVICE FOR PRINTING MACHINE

[75] Inventor: Koji Ishii, Fuchu, Japan

[73] Assignee: Ryobi Ltd., Hiroshima, Japan

[21] Appl. No.: 222,225

[22] Filed: Jan. 2, 1981

[30] Foreign Application Priority Data

Jan. 8, 1980 [JP] Japan ..... 55-842[U]

[51] Int. Cl.[3] ..... B41F 35/00

[52] U.S. Cl. ..... 101/425; 101/423; 101/217

[58] Field of Search ..... 101/425, 423, 424, 216, 101/153, 152, 364, 148, 207, 208, 209, 210, 350, 351

[56] References Cited

U.S. PATENT DOCUMENTS

| | | | |
|---|---|---|---|
| Re. 24,739 | 11/1959 | Janke et al. | 101/425 |
| 2,145,963 | 2/1939 | Lang | 101/153 |
| 3,693,547 | 9/1972 | Morgan | 101/425 |
| 4,046,070 | 9/1977 | Halley | 101/216 |
| 4,270,450 | 6/1981 | Difflipp et al. | 101/425 X |

FOREIGN PATENT DOCUMENTS

| | | | |
|---|---|---|---|
| 953732 | 4/1964 | United Kingdom | 101/216 |

*Primary Examiner*—Edgar S. Burr
*Assistant Examiner*—Charles Pearson
*Attorney, Agent, or Firm*—Sughrue, Mion, Zinn, Macpeak & Seas

[57] ABSTRACT

An offset printing machine including an impression cylinder cleaning device which is laterally positioned and removed from a location below the impression cylinder of the machine. The cleaning includes a cleaning mechanism, a window and supports in the main frame of the printing machine, and a cleaning mechanism positioning device provided on the main frame. The cleaning mechanism includes a cleaning tank and a group of rollers including a cleaning roller coupled to auxiliary frames which are rotatably supported between main frames of the cleaning mechanism. A plurality of guide bars extend from a position below the window in the printing machine frame. The cleaning mechanism positioning device brings the cleaning mechanism into the proper position below the impression cylinder once the cleaning mechanism is inserted through the window.

7 Claims, 7 Drawing Figures

IMPRESSION CYLINDER CLEANING DEVICE FOR PRINTING MACHINE

BACKGROUND OF THE INVENTION

The present invention relates to an impression cylinder cleaning device for an offset printing machine.

It is well known that a cleaning device is provided for an offset printing machine in order to remove ink from the cover of the rubber cylinder thereof. Sometimes, the circumferential wall of the impression cylinder except for the part over which printing sheets pass is stained with ink, and accordingly it is necessary to clean the impression cylinder.

In each of an offset printing machine for printing on one side of a printing sheet as shown in FIG. 1 and an offset printing machine for printing on both sides of a printing sheet as shown in FIG. 2, a cleaning device g is provided which can be set only in the space below an impression cylinder c in order to clean the cylinder c because of the arrangement of plate cylinders a and a', a rubber cylinder b, the impression cylinder c, a printing sheet feeding stand d and a printed sheet discharging stand e. The space below the impression cylinder c is a relatively closed space because both sides of the impression cylinder c are covered by the frames of the printing machine and the printed sheet discharging mechanism e and the printing sheet feeding stand d or the plate cylinder a' are disposed on either side of the impression cylinder c. Therefore, it is difficult to position the cleaning device g in the space below the impression cylinder c and a printing system with the cleaning device positioned below the impression cylinder has not been realized yet. Thus, presently, it is inefficient to clean the impression cylinder manually.

In view of the foregoing, an object of the invention is to provide an impression cylinder cleaning device which can readily fit in the space below the impression cylinder of a printing machine and removed therefrom with which an impression cylinder cleaning operation can be achieved with ease.

SUMMARY OF THE INVENTION

In accordance with this, and other objects of the invention, there is provided a printing machine having an impression cylinder cleaning device including a cleaning mechanism having a cleaning tank, a group of rollers and auxiliary frames. The rollers are rotatably supported by the auxiliary frames and are maintained in contact with one another. The rollers include a cleaning roller. Main frames rotatably support the auxiliary frames and a first lever is provided for rotating the auxiliary frames relative to the main frames so that the cleaning roller can be brought into and out of engagement with an impression cylinder of the printing machine by operating the first lever. A window is formed in a printing machine frame below the impression cylinder. A plurality of guide bars extend below the window and are supported by the printing machine frame. A bracket is coupled to the printing machine frame which is adapted to receive a portion of the main frame. A shaft with a second lever coupled to the shaft is coupled to the printing machine frame in such a manner as to provide for detachably positioning the cleaning mechanism below the impression cylinder.

A cleaning mechanism positioning device is provided having a first adjusting screw adapted to support a lower edge of one of the main frames. A lifting lever has one end thereof pivotally secured to the printing machine frame and with the first adjusting screw being threadably engaged with the other end thereof so that the portion of the main frame is fixedly abutted against a lower surface of the bracket or released therefrom. An arm is fixedly secured to the shaft at one end and rotatably coupled through a link to the lifting lever.

DESCRIPTION OF THE PREFERRED EMBODIMENTS

A preferred embodiment of the invention will be described with reference to FIGS. 3 through 7.

Figure 1:
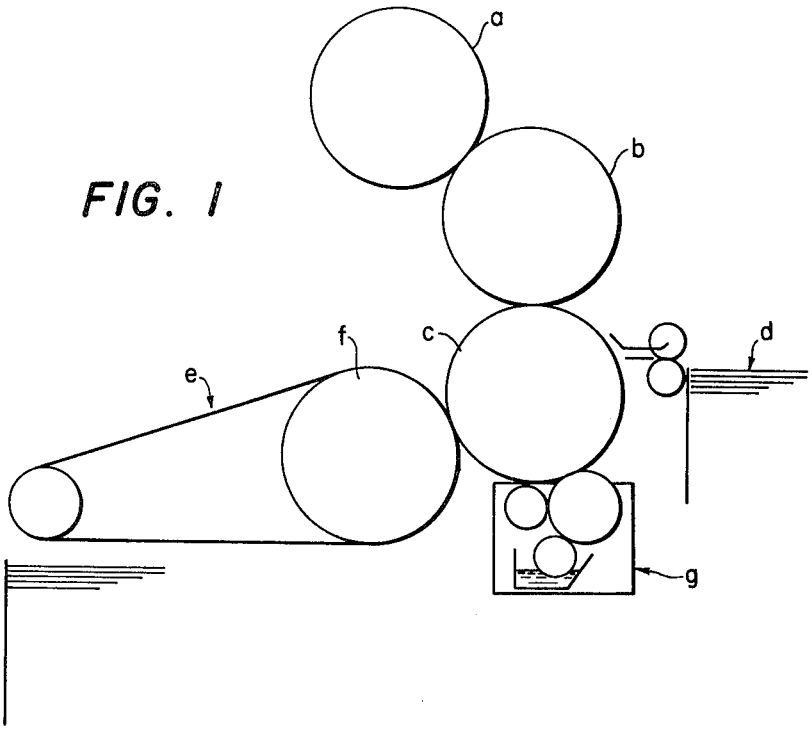
FIGS. 1 and 2 are side views of an ordinary offset single-side printing machine and an ordinary offset printing machine capable of printing on both sides of a printing sheet, respectively, each of which is provided with a cleaning device below an impression cylinder.
Figure 2:
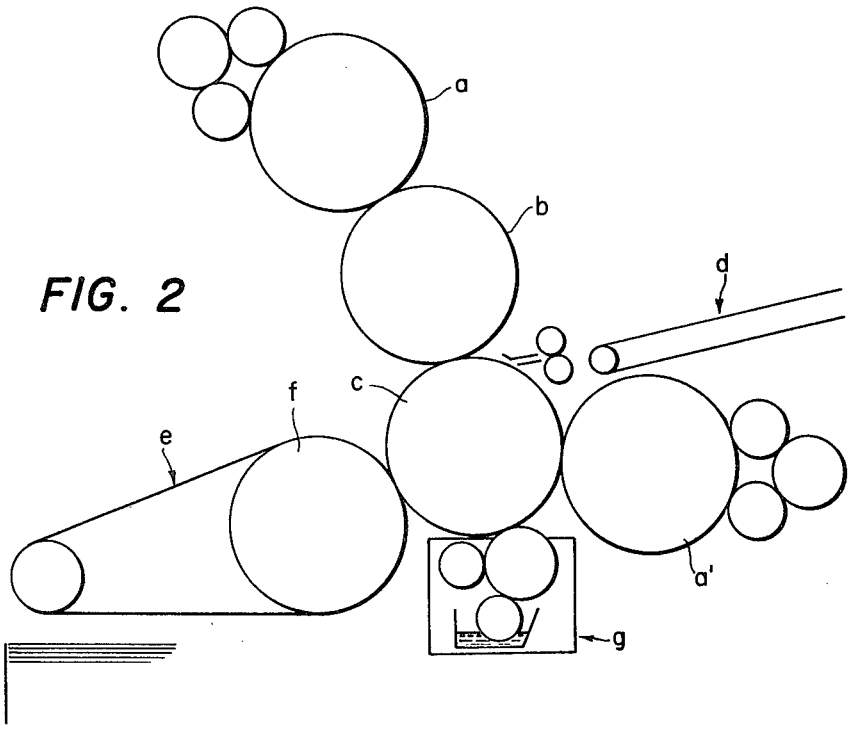
Figure 3:
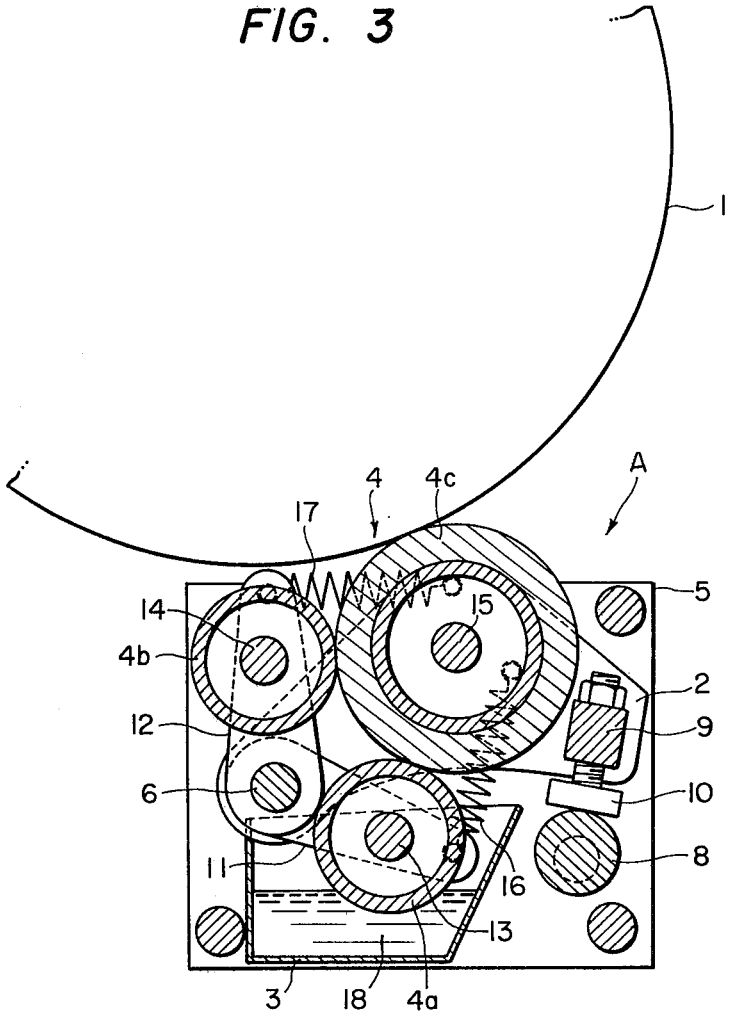
FIGS. 3 and 4 are a cross-sectional view and an unfolded diagram, respectively, showing a cleaning mechanism in an impression cylinder cleaning device according to the invention.
Figure 4:
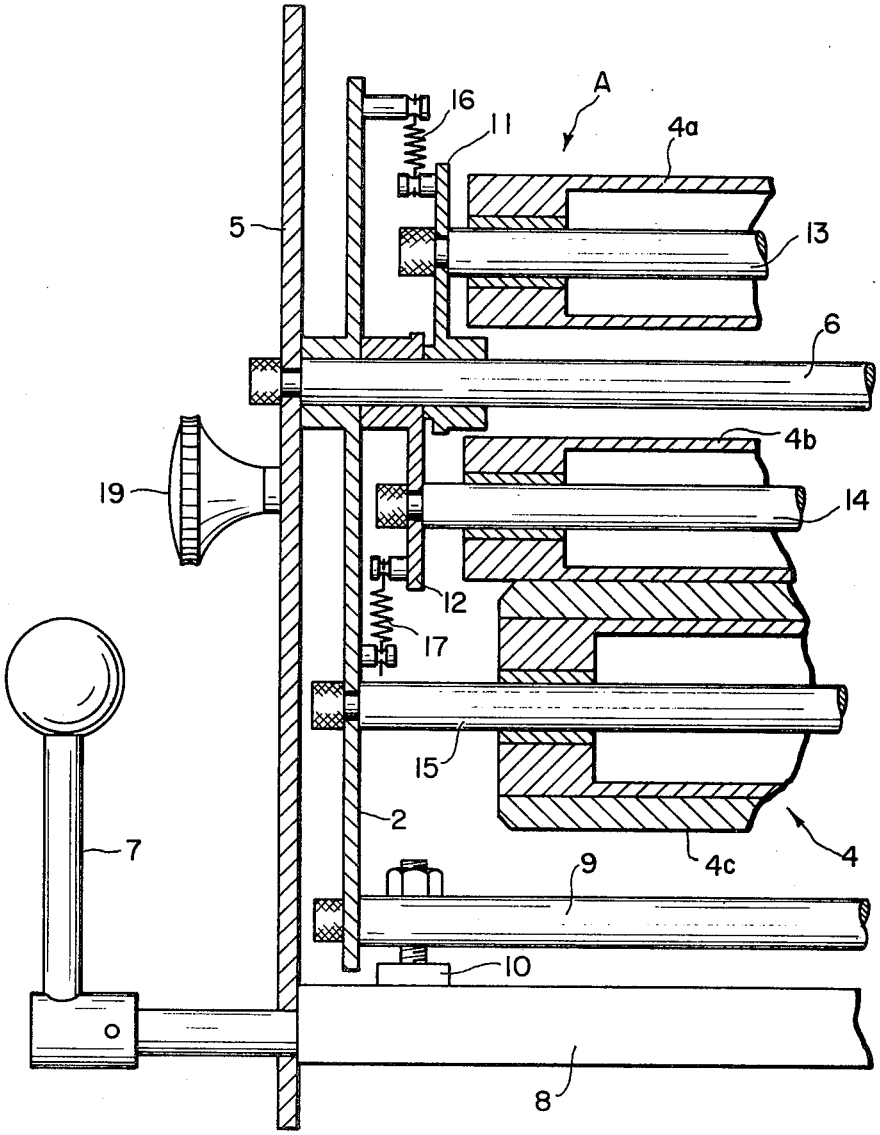

In a cleaning mechanism A disposed in a space below an impression cylinder 1, as shown in FIGS. 3 and 4, a cleaning tank 3 is supported by auxiliary frames 2 which are suitably spaced from each other. A group of rollers 4 are rotatably supported on the frames 2. The entire cleaning mechanism A is rockable around a fulcrum shaft 6 supported by main frames 5. A stationary rod 9 is supported between the auxiliary frames 2 and an adjusting screw 10 is screwed into the stationary rod 9. An eccentric shaft 8 to which is coupled a lever 7 is rotatably supported by the main frames 5. The head of the adjusting screw 10 of the stationary rod 9 abuts against the eccentric shaft 8 so that, as the eccentric shaft 8 is turned by operating the lever 7, the group of rollers 4 are swung together with the auxiliary frames 2 by as much as the amount of eccentricity whereby the cleaning roller 4*c* is moved into and out of engagement with the circumferential wall of the impression cylinder 1.

The group of rollers 4 is made up of a cleaning liquid introducing roller 4*a*, a cleaning liquid squeezing roller 4*b* and the aforementioned cleaning roller 4*c*. The rollers 4*a* and 4*b* are rotatably supported by shafts 13 and 14 on arms 11 and 12 each of which is rotatably coupled to the fulcrum shaft 6 at first ends thereof. The cleaning roller 4*c* is also rotatably supported by a shaft 15 on the auxiliary frames 2. The introducing roller 4*a* and the liquid squeezing roller 4*b* are elastically urged into contact with the cleaning roller 4*c* by springs 16 and 17 which are elastically connected between the arms 11 and 12 and the auxiliary frames 2. The cleaning liquid introducing roller 4*a* extends laterally partially into the cleaning liquid 18 in the cleaning tank 3.

A knob 19 is secured to the outer wall of the main frame 5 to allow the cleaning mechanism A to be easily pulled out.

The cleaning mechanism thus constructed is detachably disposed below the impression cylinder 1 by a cleaning mechanism positioning device B described below.

Figure 7:
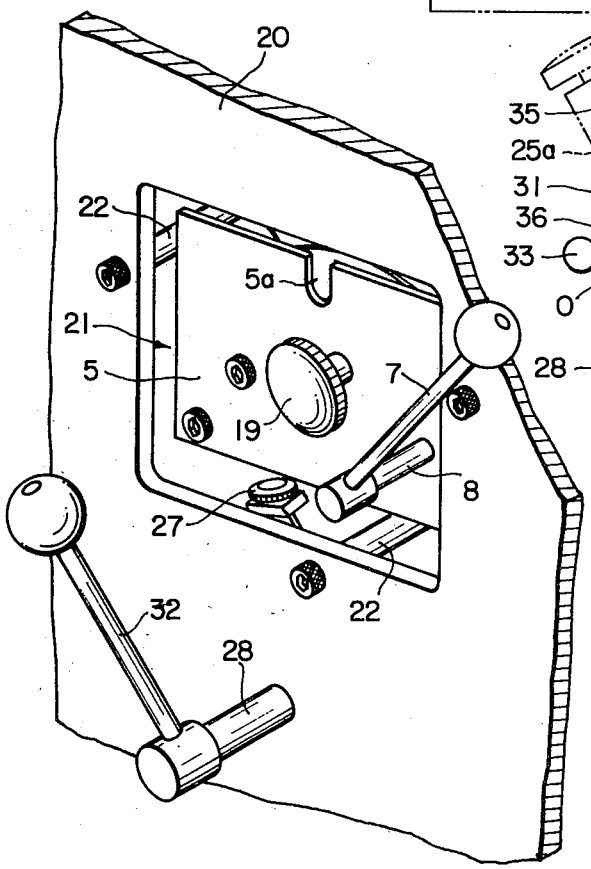
FIG. 7 is a perspective view showing a part of the cleaning device according to the invention.
Figure 6:
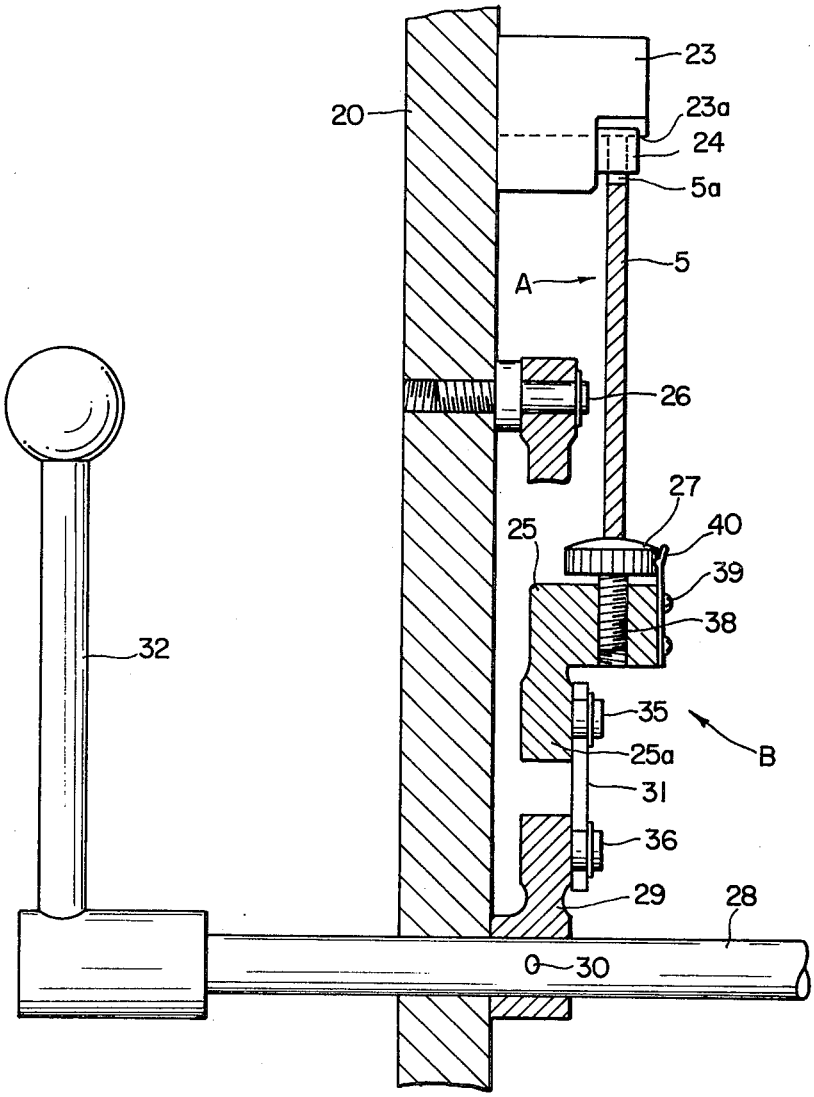

The arrangement of the cleaning mechanism positioning device B is as follows. As shown in FIG. 7, a window 21 is cut in one of the frames 20 of the printing machine of a size so that the cleaning mechanism A can pass freely through the window 21. A plurality of guide bars 22 are provided between the frames 20 so that the cleaning mechanism A can be readily inserted to a predetermined position in a predetermined direction. A bracket 23 is mounted on the inner wall of the frame 20. The bracket 23 has a lower surface 23*a* against which the upper edge of the main frame 5 presses when the cleaning mechanism is set at the predetermined position. A positioning pin 24 extends horizontally from the lower end of the bracket 23 which is engaged with a groove 5*a* which is cut in the upper edge of the main frame 5. A lifting lever 25 substantially L-shaped in section is adapted to support the lower edge of the main frame 5. More specifically, one end of the lifting lever 25 is pivotally mounted on the inner wall of the frame 20 through a pin 26 and an adjusting screw 27 is screwed into the other end of the lifting lever 25 in such a manner that the adjusting screw 27 can be screwed in and out as desired. A shaft 28 is rotatably supported by the frames 20. An arm 29 is fixedly secured to the shaft 28 with a retaining pin 30 at one end and with the other end of the arm 29 coupled through a link 31 to the bent portion 25*a* of the lifting lever 25. A lever 32 is fixedly fastened to the outer end of the shaft 28.

With this structure, as the shaft 28 is turned with the lever 32, the lifting lever 25 is turned around the pin 26 while the adjusting screw 27 on the other end of the lifting lever 25 pushes up the lower edge of the main frame 5. As a result, the main frame 5 is fixedly positioned between the adjusting screw 27 and the bracket 23. If the shaft 28 is turned in the opposite direction, the main frame 5 is released.

The arm 29 can swing, as illustrated, between the stops 33 and 34 which protrude from the frame 20. When the arm 29 abuts against the stop 33, the arm 29 is held at the position where the center 0 of the pin 36, through which the arm 29 is pivotally coupled to the link 31, is slightly away from the dead point towards the pin 33. The dead point is on a line connecting the center of the shaft 28 and the pin 35 pivotally coupling the lifting lever 25 and the link 31. The main frame 5 is thus supported so that the cleaning mechanism A is fixedly held.

The above-described adjusting screw 27 is screwed in a threaded hole 38 cut in the end portion of the lifting lever 25. A leaf spring 40 is secured to a side wall of the lever 25 in such a manner that it elastically abuts against the circumferential wall of the adjusting screw. Accordingly, the height of the adjusting screw with respect to the lifting lever 25 can be freely adjusted by turning the adjusting screw. Once the height is set, it need not be changed.

When the shaft 28 of the cleaning mechanism positioning device B thus constructed is turned clockwise, as viewed in FIG. 5, by the lever 32, the lifting lever 25 is turned counterclockwise around the pin 26 through the arm 29 and the link 31, as indicated by the two-dot chain line in FIG. 5, while the adjusting screw 27 is simultaneously lowered below the guide bar 22.

In this state, the operator can have easy access to the knob 19 of the cleaning mechanism A through the window in the frame 20 to position the cleaning mechanism below the impression cylinder or to pull it out.

Figure 5:
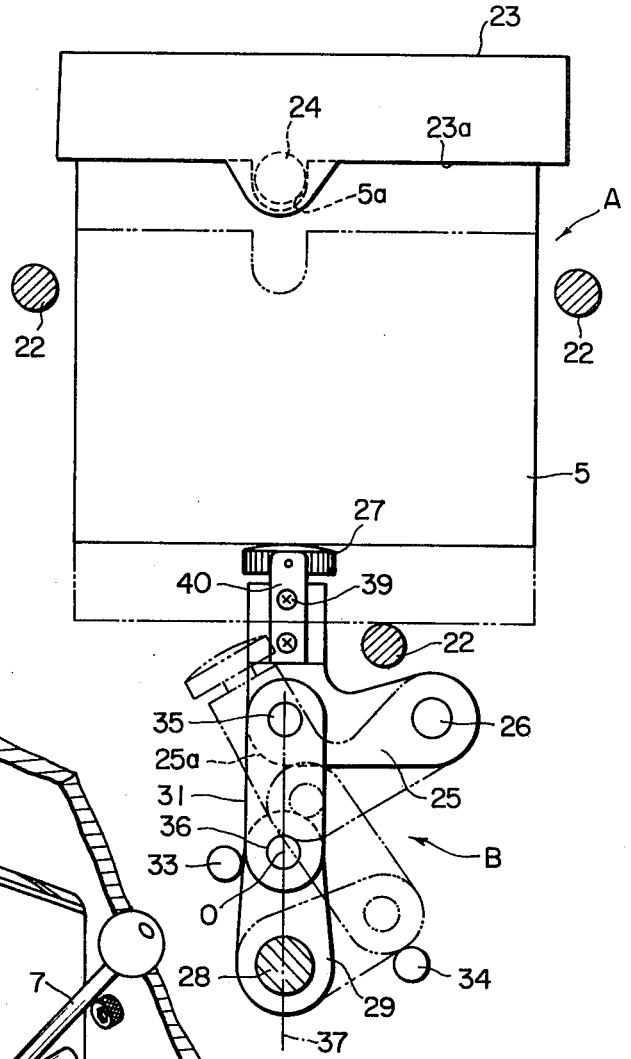
FIGS. 5 and 6 are a side view, partly as a sectional view, and an unfolded diagram, partly as a sectional diagram, showing a cleaning mechanism positioning device in the cleaning device shown in FIGS. 3 and 4.

After the cleaning mechanism A has been inserted along the guide bars 22 to the predetermined position, the shaft 28 is turned counterclockwise as viewed in FIG. 5 by the lever 32 as a result of which the lifting lever 25 is turned clockwise through the arm 29 and the link 31 while the adjusting screw 27 supports the lower edge of the main frame 5. The lever 32 is further turned until the arm 29 abuts against the stop 33 with the pin 36 pivotally coupling the arm 29 and the link 31 being slightly away from the above-described dead point. Under this condition, the adjusting screw 27 of the lifting lever 25 is at its highest position and accordingly the upper edge of the main frame 5, being pushed upwardly, comes into abutment with the lower surface 23*a* of the bracket 23. At the same time, the position pin 24 is engaged with the groove 5*a* of the main frame 5 as a result of which the cleaning mechanism A is fixedly positioned horizontally, as seen in FIG. 5, below the impression cylinder 1.

Under this condition, the lever 7 appears in the window 21. By operating the lever 7 the cleaning roller 4*c* can be brought into contact with the circumferential wall of the impression cylinder 1 as described above or can be disengaged therefrom to clean the impression cylinder 1.

When the shaft 28 is turned clockwise as viewed in FIG. 5, the lifting lever 25 is turned counterclockwise as described above to release the main frame 5 from being pushed up. As a result, the cleaning mechanism A is lowered from the position indicated by the solid line to the position indicated by the two-dot chain line. That is, the mechanism A is placed on the guide bar 22. Under this condition, the mechanism A can be removed from below the impression cylinder 1 by pulling it out with the knob 19.

The height of the main frame 5 can be changed to a desired value by screwing in or out the adjusting screw 27. Accordingly, the cleaning mechanism A can be fixedly set between the adjusting screw 27 and the bracket 23.

As is apparent from the above description, in the printing machine impression cylinder cleaning device of the preferred embodiment of the invention, the cleaning mechanism A having a group of rollers 4 (including the cleaning roller 4*c*) which can be swung by turning the lever 7 is formed as an integral unit, the window 20 is cut in one frame 20 located below the impression cylinder 1 of the printing machine through which the cleaning mechanism A can be pushed in or pulled out, and the cleaning mechanism A is fixedly fastened to the bracket 23 of the cleaning mechanism positioning device B or released therefrom by operating the lever 32 of the device B. Accordingly, although heretofore it was difficult to position a cleaning device below the impression cylinder of an offset printing machine, with the invention, a cleaning device is provided which can be fixedly positioned below the impression cylinder of such a printing machine with ease merely by operating a lever. Thus, the impression cylinder can be readily and quickly cleaned by operating the lever without making the operator's hands dirty. Furthermore, the cleaning mechanism A can be readily removed by turning the lever. Accordingly, replacement of the cleaning liquid or the roller pads of the rollers can be achieved with ease.

What is claimed is:

1. A printing machine having an impression cylinder cleaning device comprising:

a cleaning mechanism having a cleaning tank, a group of rollers and auxiliary frames, said group of rollers being rotatably supported by said auxiliary frames and said rollers being in contact with one another, said group of rollers including a cleaning roller; main frames for rotatably supporting said auxiliary frames; a first lever for rotating said auxiliary frames relative to said main frames so that said cleaning roller is brought into or out of engagement with an impression cylinder of said printing machine by operating said first lever;

a printing machine frame having a window formed therein below said impression cylinder; a plurality of guide bars, one of said guide bars extending below said window supported by said printing machine frame; a bracket coupled to said printing machine frame adapted to receive a portion of said main frame; a shaft and a second lever coupled to said shaft, said shaft being coupled to said printing machine frame for detachably positioning said cleaning mechanism below said impression cylinder; and a cleaning mechanism positioning device having a first adjusting screw adapted to support a lower edge of one of said main frames, a lifting lever having one end pivotally secured to said printing machine frame and said first adjusting screw being threadably engaged with the other end thereof so that said portion of said main frame is fixedly abutted against a lower surface of said bracket or released therefrom; and an arm fixedly secured to said shaft at one end and rotatably coupled through a link to said lifting lever.

2. The printing machine of claim 1 wherein said group of rollers includes an introducing roller, said cleaning tank being supported by said auxiliary frames with said introducing roller extending laterally partially into said cleaning tank.

3. The printing machine of claim 1 wherein said first lever comprises an eccentric shaft rotatably mounted by said main frames and a lever handle for rotating said eccentric shaft and further comprising a stationary rod supported by said auxiliary frames and a second adjusting screw screwed into said stationary rod, a head of said second adjusting screw abutting said eccentric shaft.

4. The printing machine of claim 1 further comprising spring means for urging said rollers of said group of rollers into contact with one another.

5. The printing machine of claim 1 further comprising first and second stop means positioned to determine a range of movement of said arm, one of said stop means being positioned so that said arm can extend slightly beyond a dead point thereof.

6. The printing machine of claim 1 further comprising a leaf spring elastically abutting said first adjusting screw.

7. The printing machine of claim 1 wherein said bracket has a positioning pin and a portion of said frame has a groove cut therein adapted to receive said positioning pin.

* * * * *